US008381664B2

(12) United States Patent
Prendergast

(10) Patent No.: US 8,381,664 B2
(45) Date of Patent: Feb. 26, 2013

(54) FOLDABLE TABLE

(75) Inventor: Mike Prendergast, North Yorkshire (GB)

(73) Assignee: ABF Europe Limited (GB)

( * ) Notice: Subject to any disclaimer, the term of this patent is extended or adjusted under 35 U.S.C. 154(b) by 113 days.

(21) Appl. No.: 12/676,611

(22) PCT Filed: Sep. 5, 2008

(86) PCT No.: PCT/GB2008/002995

§ 371 (c)(1), (2), (4) Date: Jul. 13, 2010

(87) PCT Pub. No.: WO2009/030911

PCT Pub. Date: Mar. 12, 2009

(65) Prior Publication Data

US 2011/0036277 A1 Feb. 17, 2011

(30) Foreign Application Priority Data

Sep. 8, 2007 (GB) ..... 0717529.2

(51) Int. Cl.
*A47B 3/00* (2006.01)

(52) U.S. Cl. ..... 108/115; 108/124; 248/167

(58) Field of Classification Search ..... 108/115, 108/116, 124, 128; 248/167, 166
See application file for complete search history.

(56) References Cited

U.S. PATENT DOCUMENTS

| | | | | |
|---|---|---|---|---|
| 914,514 | A * | 3/1909 | Rogers | 108/124 |
| 1,259,580 | A * | 3/1918 | Wurz | 108/124 |
| 1,998,519 | A * | 4/1935 | Odenwald | 108/124 |
| 2,086,380 | A * | 7/1937 | Flagstad | 108/124 |
| 2,887,348 | A * | 5/1959 | Sadowsky | 108/124 |
| 3,425,365 | A * | 2/1969 | Thoreson et al. | 108/6 |
| 3,527,174 | A * | 9/1970 | Lay | 108/115 |
| 3,722,702 | A * | 3/1973 | Marker, Jr. | 108/115 |
| 4,515,280 | A * | 5/1985 | Sheu | 108/180 |
| 5,499,883 | A * | 3/1996 | Heinzel | 108/180 |
| 5,927,214 | A * | 7/1999 | Schwartz et al. | 108/115 |
| 6,082,838 | A * | 7/2000 | Bissu-Palombo | 108/115 |
| 6,164,217 | A * | 12/2000 | Prendergast | 108/115 |
| 6,217,251 | B1 * | 4/2001 | Kato et al. | 403/341 |
| 6,257,153 | B1 * | 7/2001 | Portugal | 108/115 |
| 6,845,723 | B2 * | 1/2005 | Kottman et al. | 108/115 |
| 6,997,115 | B2 * | 2/2006 | Lockwood et al. | 108/115 |
| 2005/0274301 | A1 * | 12/2005 | Rattin et al. | 108/124 |

FOREIGN PATENT DOCUMENTS

| | | |
|---|---|---|
| DE | 12 60 095 B | 2/1968 |
| EP | 1 287 760 A | 3/2003 |
| EP | 0 966 216 B1 | 9/2003 |

OTHER PUBLICATIONS

International Preliminary Report on Patentability related to PCT/GB2008/002995.

* cited by examiner

*Primary Examiner* — Jose V Chen
(74) *Attorney, Agent, or Firm* — Woodard, Emhardt, Moriarty, McNett & Henry LLP

(57) ABSTRACT

A table (2) of a type which can be moved between storage and in use positions and which is free standing in both positions. The table typically includes at least two legs (12) connected to support arms (16) which are moveable between the two positions and which, when in the in use position engage with a frame member (34) on the underside of a table top via engagers (26, 28) having teeth which secure the leg support arms to the frame member and provide support for the table top (6).

13 Claims, 8 Drawing Sheets

FOLDABLE TABLE

REFERENCE TO RELATED APPLICATIONS

Figure 1A:
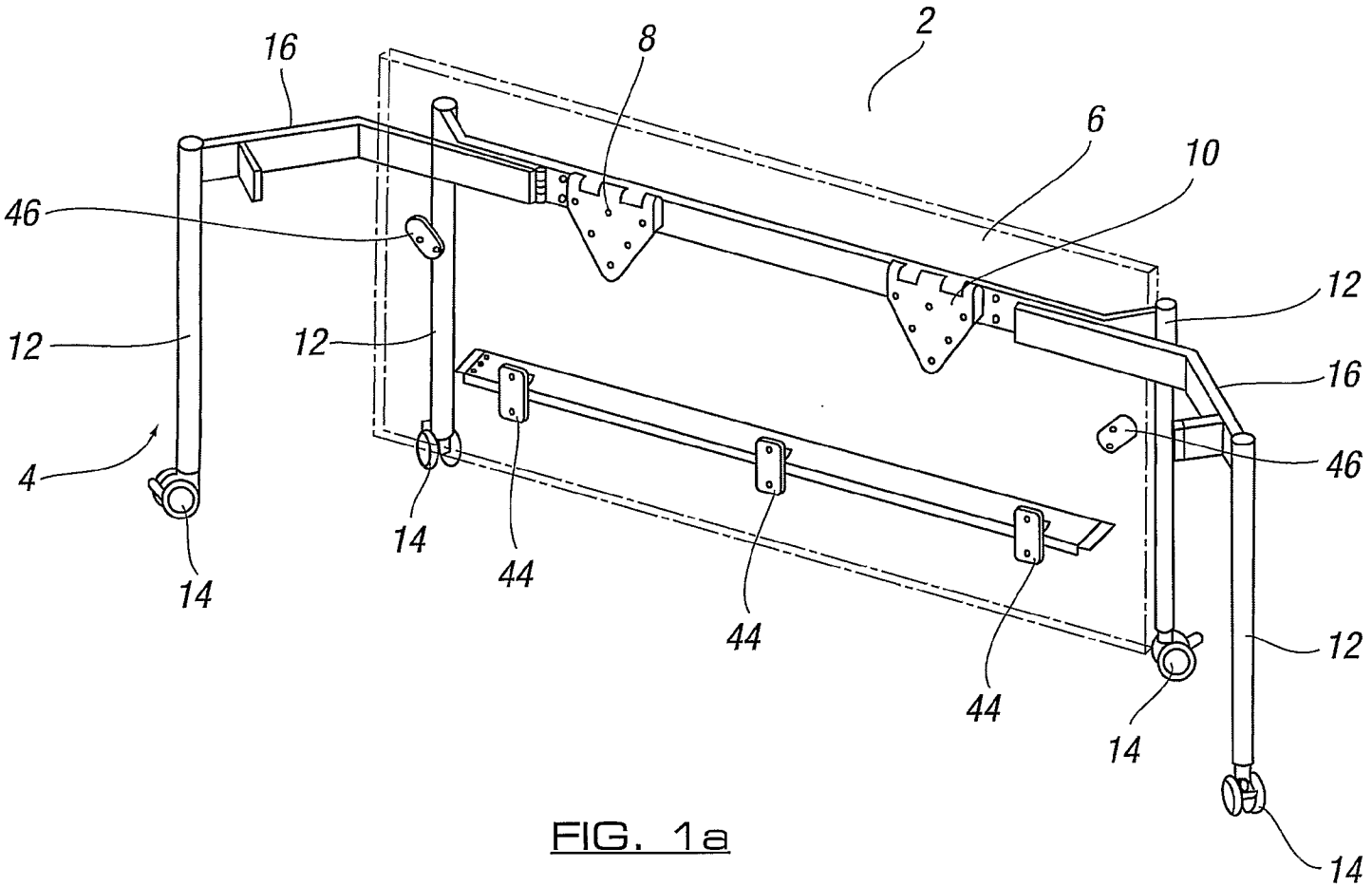

This application is the U.S. nationalization of PCT/GB2008/002995, filed Sep. 5, 2008. This application claims priority from Patent Application No. GB 0717529.2, filed Sep. 8, 2007.

The invention to which this application relates is an item of furniture such as a table, which can be moved between a storage position, and an in-use position in which the table top is in a substantially horizontal plane. When in the storage position, the table top is held in a substantially vertical plane. In both storage and in-use positions, the legs of the table are held in a substantially vertical position and there is sufficient spacing between the same so as to allow the table to remain standing in both positions and be movable along a surface such as a floor:

The applicant, in their granted patent EP0966216 describes a table of the type indicated above.

Tables of this type have been found to be commercially attractive as, in addition to being movable into a storage condition to allow a plurality of said tables to be stored and leave floor space available for other uses, the fact that the tables are movable along the surface in both storage and in-use positions, means that the same can be adapted between said positions, and moved to certain locations by any person, rather than only individuals who are particularly strong or authorised to do so. This greatly improves the speed of implementation and setting out of the tables of this type.

The applicant has undertaken ongoing development of the design of these tables and has identified a number of features which further improve the operation of the tables, while at the same time, rendering the same more economical to manufacture and, in turn, purchase.

The aim of the present invention is therefore to provide protection for these improvements to allow the more efficient use of the tables and the manufacture of the same.

In a first aspect of the invention, there is provided a table, said table comprising a table top supported by a frame, said frame having a plurality of legs, at least two of which are mounted on movable support arms which are pivotally movable between storage and in-use positions and, when in the in-use position, each of said arms engages with a frame member attached to the underside of the table top and wherein, interlocking engagement means are provided on the frame member and each of the arms, which engagement means interlock when the arms and frame member come into contact and provide support for the table top when in the in-use position.

In one embodiment, the engagement means are provided with matching teeth, said teeth in each engagement means spaced apart to form slots each slot provided for the receipt of a tooth of the other of the engagement means and thereby provide the support, when the same are inter-engaged.

In one embodiment, the engagement means are formed of plastics material and are received and retained within apertures in the frame member or support arm.

In one embodiment, retaining means are provided to ensure that the engagement means are retained within the frame member or support arm.

In one embodiment, the engagement means are formed such that the pivotal movement of each of the support arms with respect to the frame member, is guided, at least in its final stages, by the teeth of the engagement means as they inter-engage.

In this manner, the inter-engagement of the engagement means, also acts to align the support arms with the frame member and, in turn, ensure that the table top, which is supported on the frame, is held in a substantially horizontal plane when in the in-use position.

In one embodiment, once the engagement means are inter-engaged, a latch or other locating device, can be moved to a latching position to thereby retain the respective support arm in location with the frame member. Typically a latch is provided for each of the support arms with respect to the frame member. Once the latches are in position, the frame is formed and all of the legs of the table top are locked in the in-use position.

Typically, in order to move the table from the in-use position to the storage position, the latches are released and then the support arms are pivotally moved so as to disengage the respective engagement means.

Typically the support arms for the legs include at least one bend, so as to ensure that when the support arms are moved to the storage position, the respective legs of the support arms, and the remaining legs of the table, are still sufficiently spaced and located so as to ensure that the table is self supporting.

Typically, the legs will include castors or wheels at the base thereof to allow the table to be moved along the surface in both storage and in-use positions.

In one embodiment, the table is provided with spacer means which are attached to the underside of the table top at selected locations so as to ensure that the table top is held in a substantially horizontal plane when in the in-use position.

In one embodiment, spacer means are provided to be between the frame member and the underside of the table top and also between the support arms and the underside of the table top when the table is in the in-use position.

Typically, the spacer means which are located for the support arms, include ramped portions at the leading edge thereof so that the support arms, when being moved to the in-use position, contact the spacer means at a reduced width and the ramp portions serve to guide the arm onto the full depth of the spacer when in the in-use position.

Typically, the support arms are pivotally mounted with regard to a fixed frame assembly, said fixed frame assembly including at least one, but typically two legs mounted in a fixed position.

Typically the frame assembly is mounted adjacent one longitudinal edge of the table top and the frame member, with engagement means, is also in a fixed position adjacent the opposing edge of the table top.

In one embodiment, the provision of the spacers, allows standard size tubular members to be used for the frame, typically of dimensions 20 mm×70 mm in rectangular cross section.

Figure 1B:
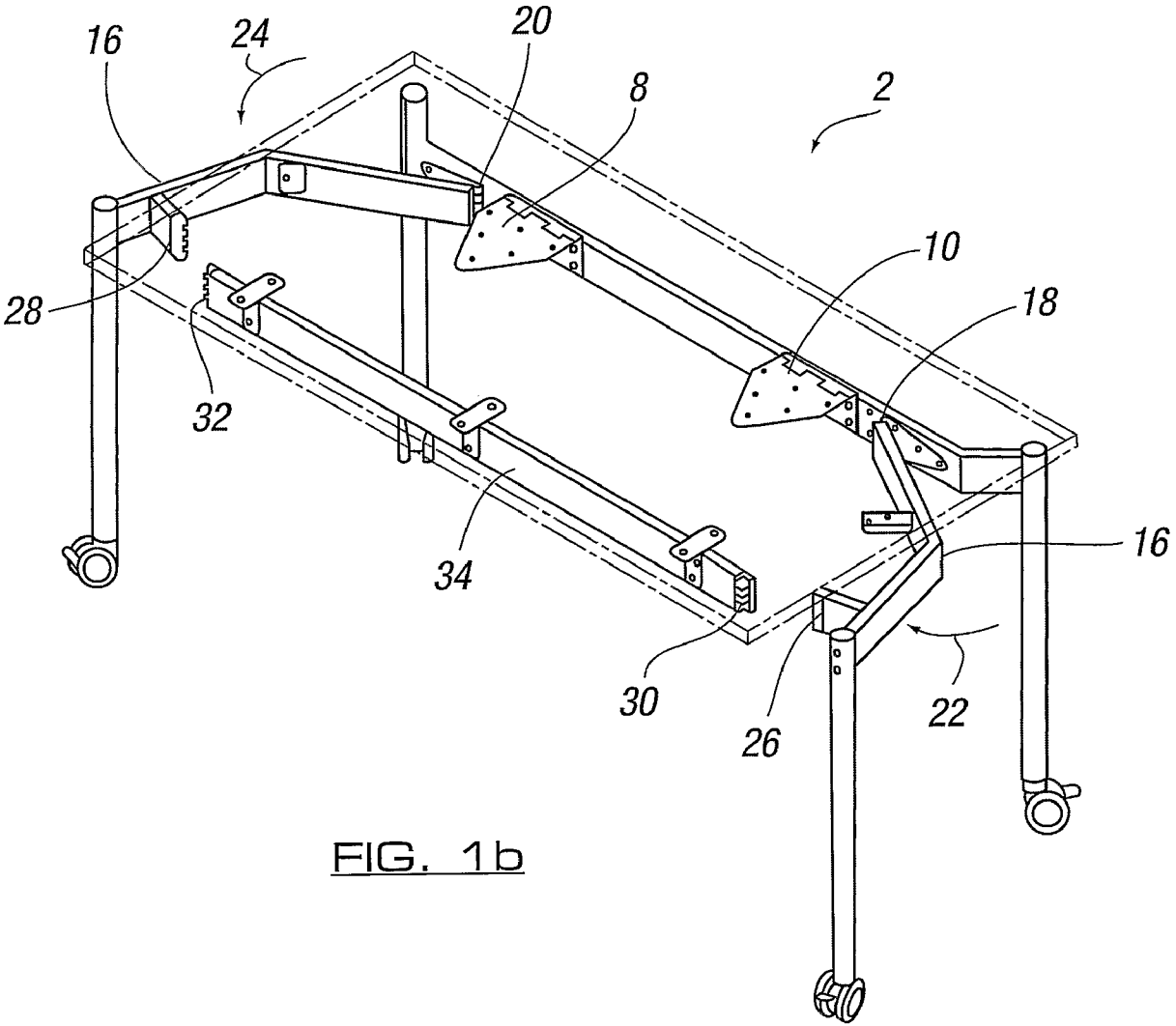
Figure 1C:
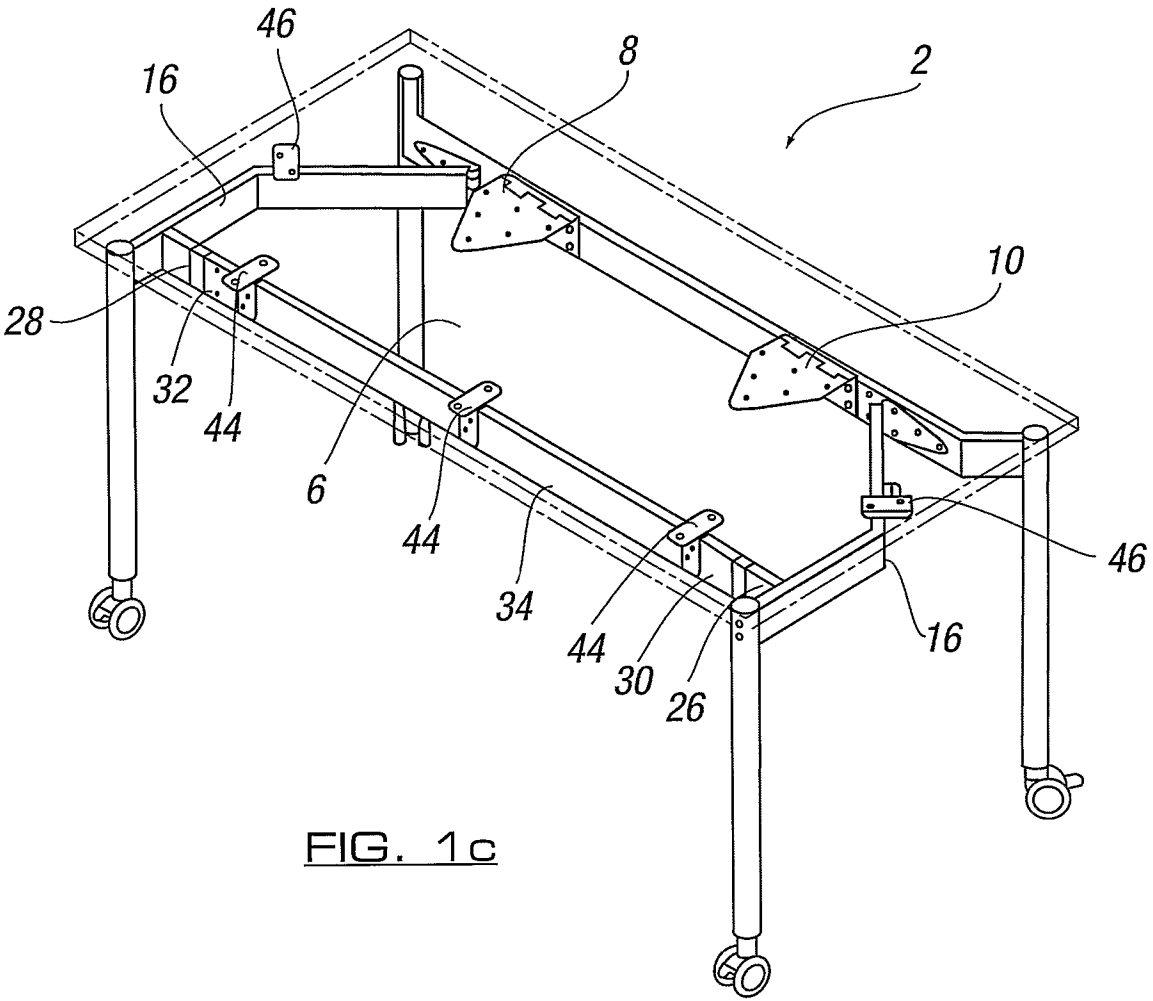
Figure 2A:
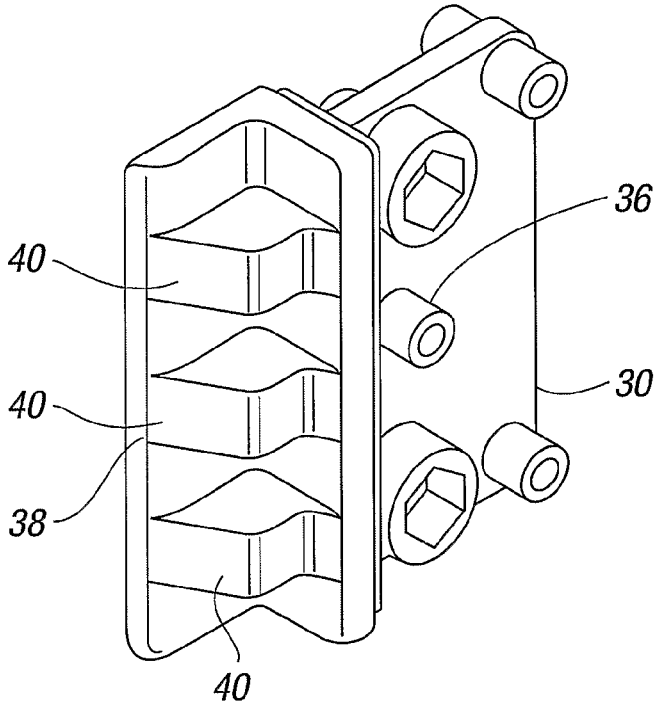
Figure 2B:
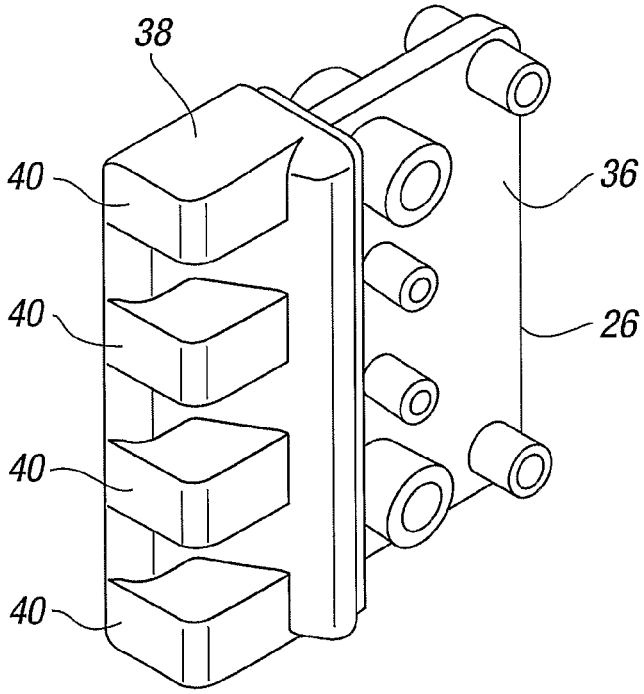
Figure 3A:
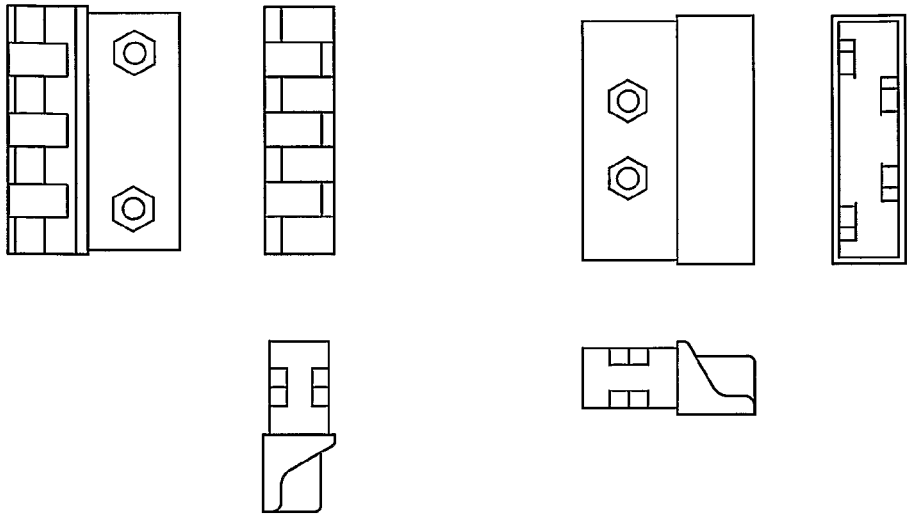
Figure 3B:
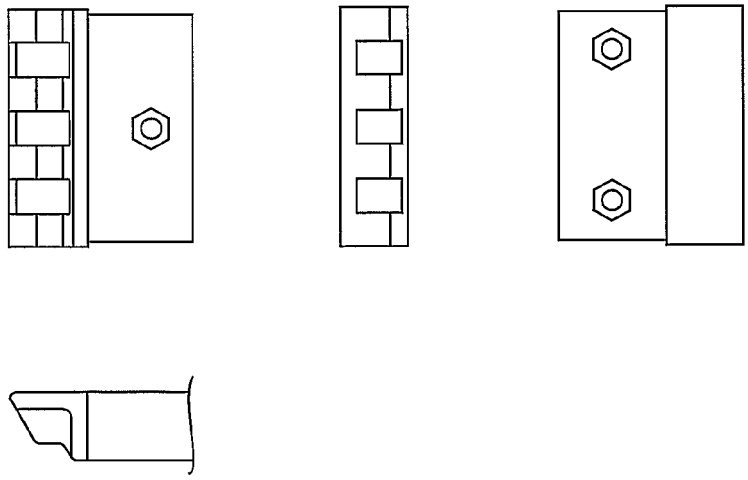
Figure 3C:
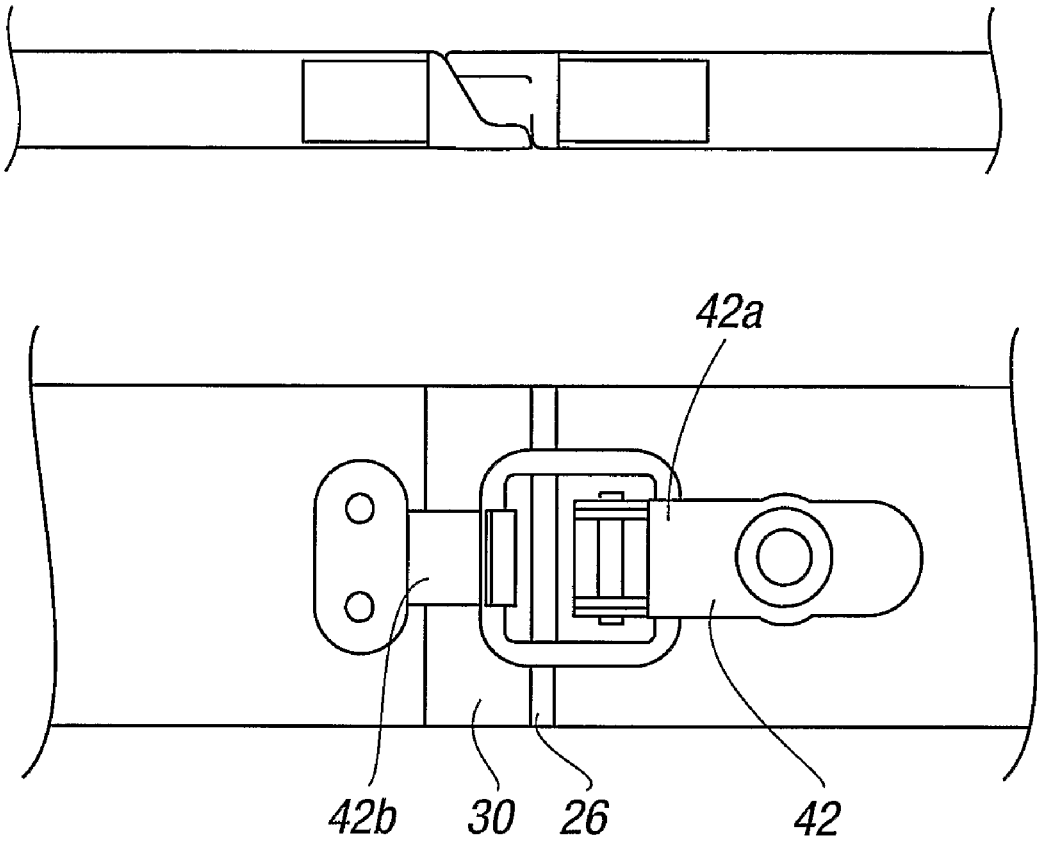
Figure 4A:
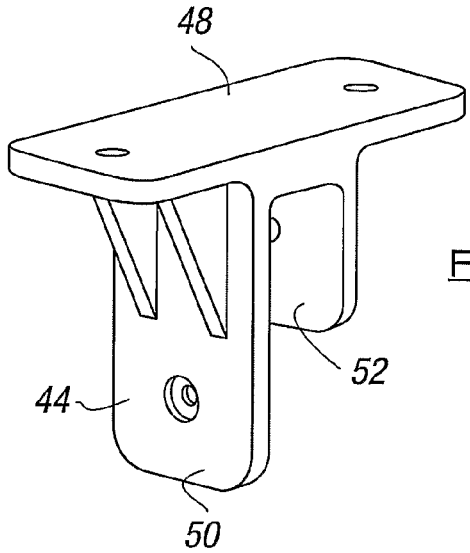
Figure 4B:
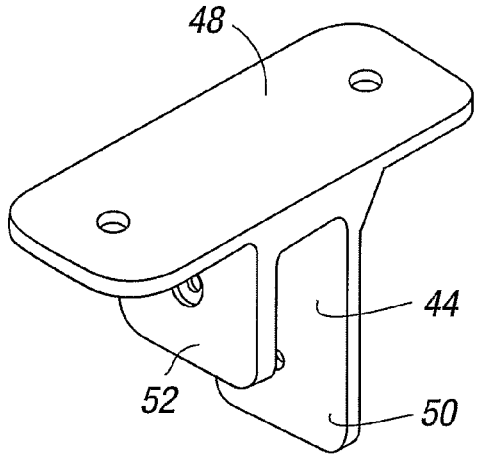
Figure 5:
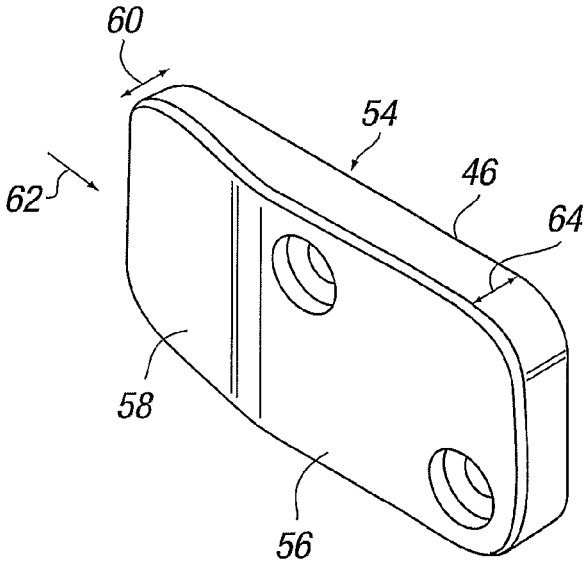
Figure 6:
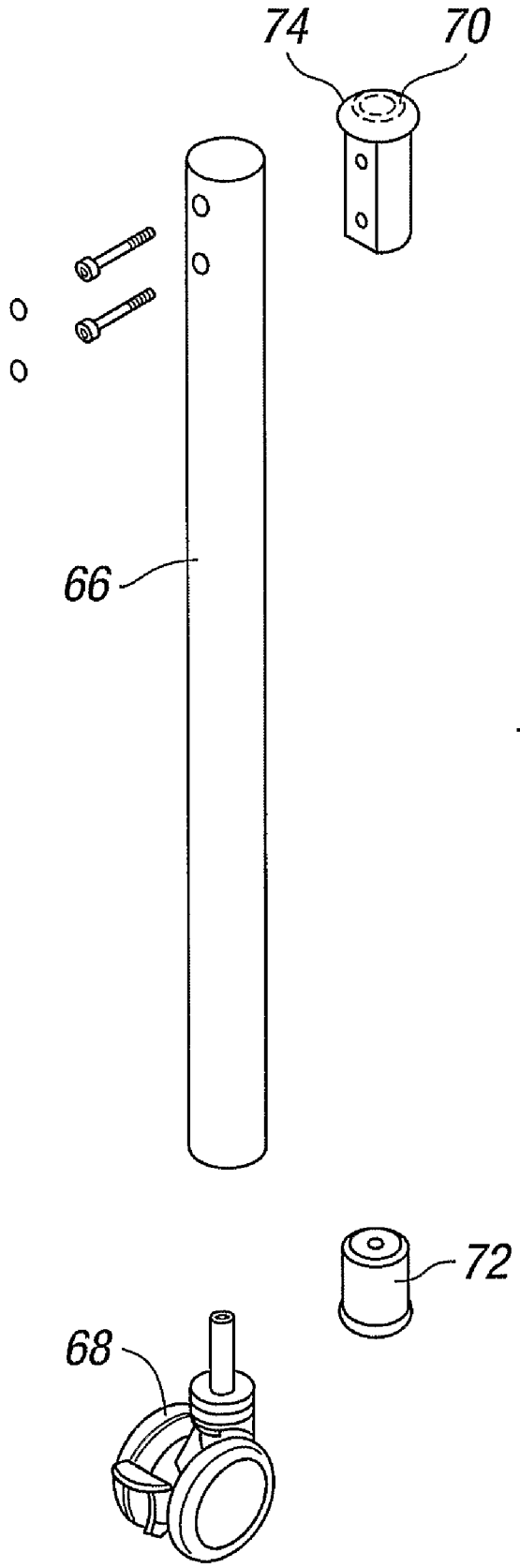

Specific embodiments of the invention are now described with reference to the accompanying drawings, wherein:

FIGS. 1*a* to *c* illustrate the table in accordance with one embodiment of the invention in storage, intermediate and in-use positions respectively;

FIGS. 2*a* and *b* illustrate engagement means in accordance with one embodiment of the invention;

FIGS. 3*a* to *c* illustrate the engagement means and latch in accordance with one embodiment of the invention;

FIGS. 4 and 5 illustrate embodiments of spacers in accordance with one embodiment of the invention; and FIG. 6 illustrates a table leg assembly in accordance with one embodiment of the invention.

Referring firstly to FIGS. 1*a* to *c*, there is illustrated a table 2 in accordance with one embodiment of the invention. The table comprises a frame assembly 4 which will be described in more detail subsequently, and a table top 6 which is hingedly connected to the frame via hinges 8, 10. The table, for purposes of illustration, is shown as substantially transparent so as to allow the components of the frame to be viewable.

Referring firstly to FIG. 1*a*, it will be seen how the legs 12 of the frame 4, are spaced apart, even with the table in a storage position, to a sufficient extent so as to allow the rollers or castors 14 on the legs, to be used to move the table about a surface such as a floor and also, for the table, even in the storage position, to be self supporting and upstanding. Furthermore, the table top is in a substantially vertical plane thereby greatly reducing the overall envelope area of the table when in the storage position and a number of said tables can be nested together in storage.

When it is desired to use the table in the in-use position, the support arms 16 of the frame are pivotally moved about respective pivot locations 18, 20 as indicated by arrows 22, 24 respectively. In the intermediate position, shown in FIG. 1*b*, engagement means 26, 28 approach matching engagement means 30, 32 respectively, which are provided at the ends of a fixed frame member 34 which is fixed to the underside of the table top 6. Continued movement of the support arms 16 in this manner, bring the respective engagement means into an inter-engaging relationship as shown in FIG. 1*c*. This inter-engagement, in addition to providing support for the frame and the table top thereon, also acts to align the frame member 34 with the support arms 16 and therefore ensure that the table top 6 is held in the substantially horizontal plane as desired.

FIGS. 2*a* and *b* illustrate the engagement means 26, 30, in more detail. Each of the engagement means, includes a retaining part 36 which is designed to fit within the open end of the support arm or in an aperture in the frame member 34, respectively. A series of apertures can be provided which match with apertures formed in the frame member or support arm to allow the engagement of screws or other retention means in order to retain the engagement means in position. Each of the engagement means also includes a protruding portion 38 which has a series of teeth 40 formed thereon. The teeth for the respective engagement means 26, 30 are offset and are provided with slots between the teeth so that the same inter-engage when the engagement means are brought together so that effectively a locking relationship is achieved. Said interlocking relationship ensures that the respective support arm and frame member are aligned correctly. Furthermore, the inter-engagement of the teeth provides support typically in the vertical axis and also acts to reduce the opportunity for the separation of the support arm from the frame member.

FIGS. 3*a* to *c* illustrate the engagement means once again in more detail and also, in FIG. 3*c*, illustrate how a latch 42 can be provided with a first part of the latch 42*a* provided on one of the support arm or frame member and the other part of the latch 42*b* provided on the other of the frame member or support arm. The latch is provided to be engaged by engaging parts 42*a* and 42*b*, and to straddle the inter-engaged engagement means 30, 26 so as to secure the support arm in mechanical engagement with the frame member. Thus, the latch is moved to a latched position once the engagement means have inter-engaged and therefore the support arm lies in contact with the frame member.

A latch is provided at the location of each of the engagement means and, once latched, the frame is locked in position during use of the table.

In addition to the provision of the engagement means, in the embodiment shown in FIGS. 1*a* to *c*, there are provided a plurality of spacer members 44, 46. The spacer members 44 are shown in more detail in FIGS. 4*a* and *b* and comprise a plate 48 which is secured to the underside of the table 6 and two downwardly depending arms 50, 52 which lie to either side of the frame member 34 to secure the frame member to the space members and return to the underside of the table.

The spacers 46, are shown in more detail in FIG. 5 and include a first face 54 which is to contact the underside of the table 6 and an opposing face 56 which has a ramped portion 58 and which contacts with the support arm, when the support arm is moved to the in-use position. The ramped portion 58 is provided to have a minimum depth 60 at the location at which the support arm first contacts the spacer as it is moved in direction 62 towards the in-use position, and the greatest depth 64 at the location where the support arm rests when the table top is in the in-use position shown in FIG. 1*c*. The provision of the spacer members ensures that the table top 6 is maintained in a substantially horizontal plane during use and furthermore allows the option of using tubular members of a standard size, thereby reducing manufacturing costs.

FIG. 6 illustrates a leg assembly comprising an elongate tubular member 66 which receives, at the base, a castor 68 and at opposing ends top and bottom covers 70, 72. If required, these covers can be arranged so as to act as further spacer members, with the top cover 70 if required, having a portion 74 of a dimension so-as to contact with the underside of the table top.

There is therefore provided in accordance with the invention and efficient and effective manner of providing a table which can be moved between storage and in-use positions and to provide the same in an improved manner with regard to the prior art.

The invention claimed is:

1. A table, said table comprising a table top supported by a frame, said frame having a plurality of legs, at least two of which are mounted on movable support arms which are pivotally movable between storage and in-use positions and, when in the in-use position, each of said arms engages with a frame member attached to the underside of the table top, interlocking engagement means are provided on the frame member and each of the arms, which engagement means interlock when the arms and frame member come into contact and provide support for the table top when in the in-use position wherein spacer means are provided which are attached to the underside of the table top at selected locations such that a spacer lies between each of the support arms and the underside of the table top when the table is in the in-use position, said spacer means include a ramped portion at the leading edge thereof so that the support arm, when being moved to the in-use position, contact the respective spacer means at the ramp portion which serves to guide the arm onto the full depth of the spacer when in the said in-use position, said spacer means located to contact with the respective support arm at a position intermediate the opposing ends of the support arm.

2. A table according to claim 1 wherein the engagement means are provided with matching teeth, said teeth in each engagement means spaced apart to form slots each slot provided for the receipt of a tooth of the other of the engagement means and thereby provide support, when the same are interlocked.

3. A table according to claim 1 wherein the engagement means are received and retained within apertures in the frame member or support arm.

4. A table according to claim 3 wherein retaining means are provided to ensure that the engagement means are retained within the frame member or support arm.

5. A table according to claim 1 wherein the engagement means are formed such that the pivotal movement of each of the support arms with respect to the frame member, is guided, at least for part of the movment, by teeth of the engagement means as they inter-engage.

6. A table according to claim 5 wherein the engagement means aligns the support arms with the frame member and, in turn, ensures that the table top, which is supported on the frame, is held in a substantially horizontal plane when in the in-use position.

7. A table according to claim 1 wherein once the engagement means are inter-engaged, a latch or other locating device is moved to a latching position to thereby retain the respective support arm in location with the frame member.

8. A table according to claim 7 wherein to move the table from the in-use position to the storage position, the latches are released and then the support arms are pivotally moved so as to disengage the respective engagement means.

9. A table according to claim 1 wherein a latch is provided for each of the support arms and, once locked the table is locked in an in use position.

10. A table according to claim 1 wherein the support arms for the legs include at least one bend such that when the support arms are moved to the storage position, the respective legs of the support arms, and the remaining legs of the table, are still sufficiently spaced and located so as to ensure that the table is self supporting.

11. A table according to claim 1 wherein the legs include castors or wheels at the base thereof to allow the table to be moved along a surface in both storage and in-use positions.

12. A table according to claim 1 wherein the support arms are pivotally mounted with regard to a fixed frame assembly, said fixed frame assembly including at least one leg mounted in a fixed position.

13. A table according to claim 12 wherein the frame assembly is mounted adjacent one longitudinal edge of the table top and the frame member, with engagement means, is in a fixed position adjacent the opposing edge of the table top.

* * * * *